US005197207A

United States Patent [19]

Shorten

[11] Patent Number: 5,197,207

[45] Date of Patent: Mar. 30, 1993

[54] SHOE, ESPECIALLY A SPORT OR REHABILITATION SHOE

[75] Inventor: Martyn R. Shorten, Portland, Oreg.

[73] Assignee: Tretorn AB, Helsingborg, Sweden

[21] Appl. No.: 707,861

[22] Filed: May 31, 1991

[30] Foreign Application Priority Data

May 31, 1990 [DE] Fed. Rep. of Germany ..... 9006186

[51] Int. Cl.[5] ..... A43B 13/20; A43B 13/18

[52] U.S. Cl. ..... 36/29; 36/28

[58] Field of Search ..... 36/28, 29, 59 C, 71, 36/3 B, 44, 143, 144; 428/116, 118; 5/435, 442, 444, 452, 455, 464, 476, 481

[56] References Cited

U.S. PATENT DOCUMENTS

| | | | |
|---|---|---|---|
| 532,429 | 1/1895 | Rogers . | |
| 1,559,532 | 10/1925 | Smith . | |
| 3,738,373 | 6/1973 | Gancy | 36/144 |
| 3,876,493 | 4/1975 | Gilmore | 36/71 |
| 4,241,465 | 12/1980 | Yarimie et al. | 5/452 |
| 4,291,080 | 9/1981 | Ely et al. | 428/116 |
| 4,472,890 | 9/1984 | Gilbert | 36/28 |
| 4,485,568 | 12/1984 | Landi et al. | 36/44 |
| 4,583,338 | 4/1986 | Sewell et al. | 428/116 |
| 4,970,807 | 11/1990 | Anderie et al. | 36/28 |
| 5,005,300 | 4/1991 | Diaz et al. | 36/28 |
| 5,084,987 | 2/1992 | Flemming | 36/28 |
| 5,092,060 | 3/1992 | Frached et al. | 36/28 |

FOREIGN PATENT DOCUMENTS

| | | | |
|---|---|---|---|
| 513375 | 10/1939 | United Kingdom | 36/59 C |

*Primary Examiner*—Steven N. Meyers

*Attorney, Agent, or Firm*—Sixbey, Friedman, Leedom & Ferguson

[57] ABSTRACT

A sport shoe or rehabilitation shoe with a shoe sole with at least one insert part that is formed as a honeycomb body of elastic compressible material, the cells of which have central axes that run at least approximately perpendicular to the sole plane, has honeycomb cells in an area under a flexible zone of the forefoot which are provided with a surface area that increases, as seen in top view, from one side edge to an opposite side edge of the sole or midsole. This feature has the effect of achieving a stabilizing of the foot in running, especially in long-distance running, for example, in jogging, cross-country running, marathon running or the like, in the area of the forefoot, if the user's foot usually tends to tilt inward or outward (forefoot varus or valgus) in running. Further, the damping effect and the flexibility of such a shoe in the area of the forefoot are optimized.

19 Claims, 2 Drawing Sheets

SHOE, ESPECIALLY A SPORT OR REHABILITATION SHOE

BACKGROUND OF THE INVENTION

This invention relates to a shoe, especially a sport shoe or rehabilitation shoe with a shoe sole with at least one insert part that is formed as a honeycomb body of elastic compressible material, the cells of which have central axes that run at least approximately perpendicular to the sole plane.

From U.S. Pat. No. 4,485,568, an insole for a shoe is known, which exhibits a honeycomb structure. The upper side of this insole consists of an air-permeable material and the underside of a thin backing. On the peripheral edge the honeycomb cells, which are applied between the foamed padding (upper side) and the thin backing, are at least partially open, since the honeycomb body is produced from undulating or meander-shaped strips glued together on the walls and then stretched so that honeycomb cells of longitudinally extended rectangular form result. Such honeycomb bodies, as a result of the laterally open edge honeycomb cells, have a greatly decreasing damping toward the edge, so that the restoring force of such a honeycomb body in the edge areas also tends almost toward zero. This is not favorably influenced or compensated even by the upper side and underside being joined on the edge. For an insole, this result is not very disturbing, since the form of the insole generally corresponds approximately to the projection of the foot on the shoe bottom and the edge of the insole hardly serves for supporting the foot.

Cushion soles are also known (see, for example, U.S. Pat. Nos. 532,429 and 1,559,532) in which honeycomb air cushion inserts are provided in heel and forefoot regions of an insole or outsole. In these cushion soles, the peripheral cells of the insert are closed at their side edges; however, the ends of the cells are open and the insert is disposed in or on another sole layer to produce an air cushion effect. Also, the cells or partial cells at the periphery of the cushion inserts are smaller than the other cells, which are all of the same size.

With known honeycomb structures, since all of the honeycomb cells are designed in the same way, except at the edge area, the damping and restoring force are essentially uniform, except for at an edge or narrow peripheral area.

Summary of the Invention

The primary object of this invention is to achieve a shoe, especially a sport shoe or rehabilitation shoe, of the initially mentioned type, in which a honeycomb body is provided, in an area under a flexible zone of the forefoot, with honeycomb cells which increase in their surface area, as seen in top view, from one side edge to an opposite side edge of the honeycomb body, across the sole or midsole of the shoe.

This feature has the effect of achieving a stabilizing of the foot in running, especially in long-distance running, for example, in jogging, cross-country running, marathon running or the like, in the area of the forefoot, if the user's foot usually tends to tilt inward or outward (forefoot varus or valgus) in running. Further, the damping effect and the flexibility of such a shoe in the area of the forefoot are optimized.

In the case of a user who is prone to an inward tilting (forefoot varus), an increased stability is achieved on the inner (medial) side of the sole or midsole by honeycomb cells of smaller surface area. On the other hand, if there is a danger of outward tilting (forefoot valgus), the honeycomb cells are made smaller in surface area toward the outer (lateral) side, and thus, the stability is increased.

Other advantageous details of the invention are described in greater detail below with reference to the embodiments illustrated in the drawings.

DETAILED DESCRIPTION OF THE PREFERRED EMBODIMENTS

Figure 1:
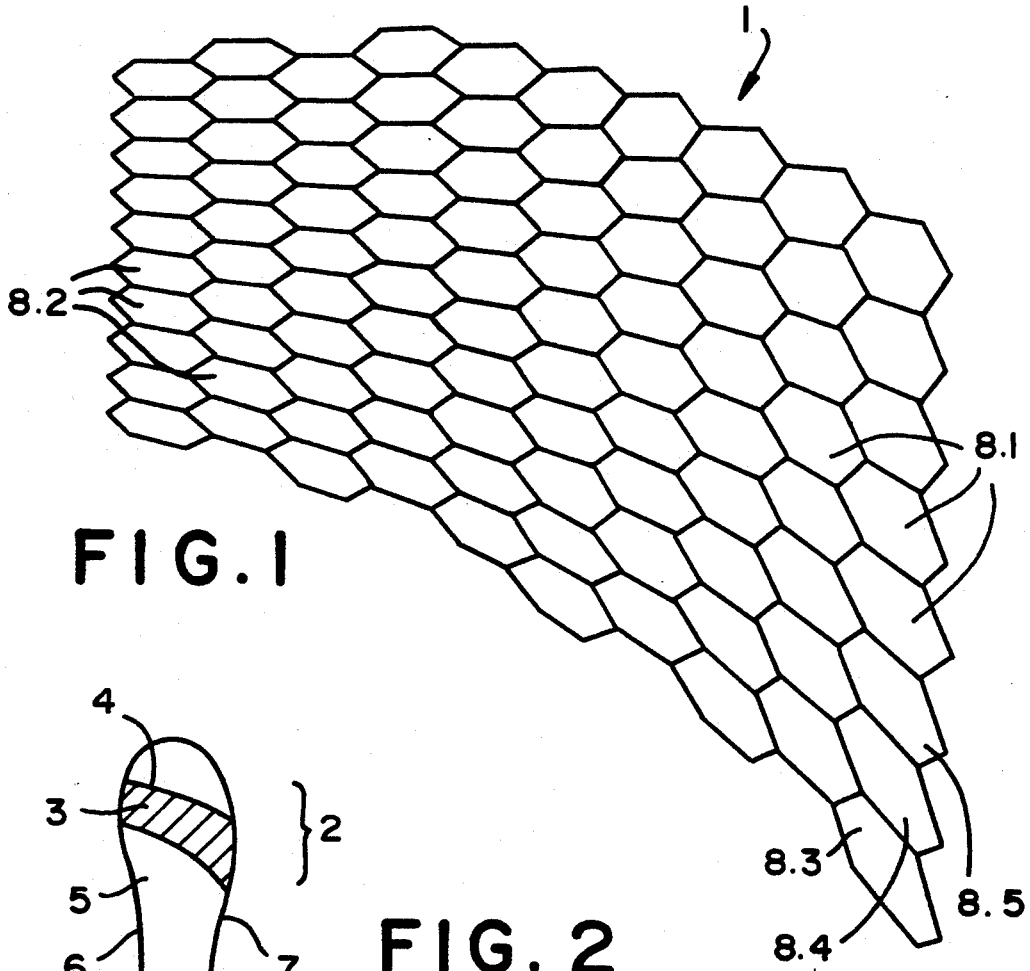
FIG. 1 shows a top view of a honeycomb body for a right foot which tends to tilt inward (forefoot varus)
Figure 2:
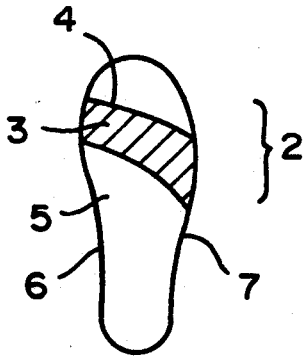
FIG. 2 is a top view of the sole or midsole of the right shoe with the indicated arrangement of the honeycomb body according to FIG. 1 in the area of the forefoot.

A honeycomb body in the form of a prefabricated insert part 1 is disposed in an area 2 under a flexible zone 3 of the forefoot (indicated by hatching in FIG. 2) in a recess 4 of sole or midsole 5. Honeycomb body 1 runs in a slightly curved manner from inner side 6 to outer side 7, sloping backward from the inside to the outside of the sole or midsole 5.

In this embodiment, the surface area of honeycomb cells 8.1, as seen in top view, become smaller, continuously or by steps, from outer side 7 toward honeycomb cells 8.2 of inner side 6. As a result, the stability of the forefoot area 3 is increased toward inner side 6 of sole or midsole 5. This embodiment is suitable for a wearer whose foot tends, for example, to tilt inward in long-distance running, which among experts is called "forefoot varus."

Figure 3:
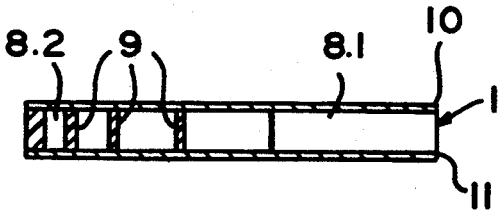
FIG. 3 is a rear sectional view of the honeycomb body of FIG. 1 in a modified embodiment.

According to FIG. 3 this effect can be increased even more by making thickness of the honeycomb walls 9 of smaller honeycomb cells 8.2 thicker, and thus more stable, in comparison with the walls of the larger honeycomb cells 8.1, for example. This stability can also be changed continuously or in steps.

Figure 4:
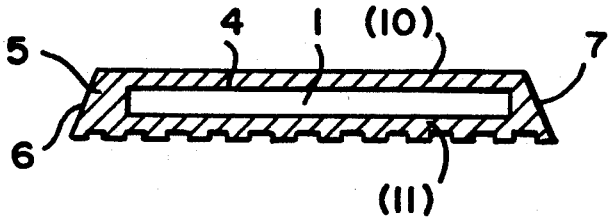
FIG. 4 shows a cross section through the sole or midsole in the area of the forefoot.

Honeycomb body 1 is designed almost or completely gastight, which can take place by a correspondingly applied upper covering layer 10 and a lower covering layer 11 (FIG. 3). These covering layers 10, 11 can also be parts of sole or midsole 5, as indicated in FIG. 4.

Honeycomb body 1 consists of an elastic, compressible material, for example, of polyethylene, polyurethane, polyether or the like.

Honeycomb body 1 can be produced, for example, by an injection molding process or can be a disk cut from an extruded product. The cells of honeycomb body 1, at first, are open at top and bottom. In this form the honeycomb body can be inserted in recess 4 of the sole or midsole 5, where an upper covering layer 10, formed by the insole, and a lower covering layer 11, formed by the outsole, close the individual honeycomb cells in a practically gastight manner. However, preferably, the honeycomb body is closed tight, especially gastight, above and/or below with a covering layer of its own, as shown in FIG. 3.

According to an advantageous embodiment of the invention represented in FIGS. 5 to 9, honeycomb body 1 is provided with an edge flange 14 projecting from edge 12 in the directions 13, parallel to the plane of the sole 5. Sole 5 is comprised of a midsole 5*a* and an outsole 5*b*, with the honeycomb body 1 received in midsole 5*a* and solidly bonded, for example, vulcanized, glued or hot-sealed, to outsole 5*b* by the edge flange 14. The production takes place, for example, so that side 16 of honeycomb body 1 facing tread surface 15 of sole 5 is provided with a cover layer 11, or this cover layer 11 is co-molded in the production of honeycomb body 1 and this honeycomb body 1 is inserted in a sole injection mold. In the injection molding of sole 5, the sole material is bonded with the material of edge flange 14. In this way, a one-piece, practically homogeneous outsole is obtained from different molded parts. As material for sole 5, honeycomb body 1 and cover layer 11, preferably, similar materials are used, which bond well to one another. For example, the sole parts are made of rubber, a rubber-plastic mixture or a plastic. If cover layer 11 is sufficiently thick, it can serve directly as part of the tread surface. In this case, sole 5, produced in the sole injection mold, has a recess 17, which is not filled with sole material.

Figure 5:
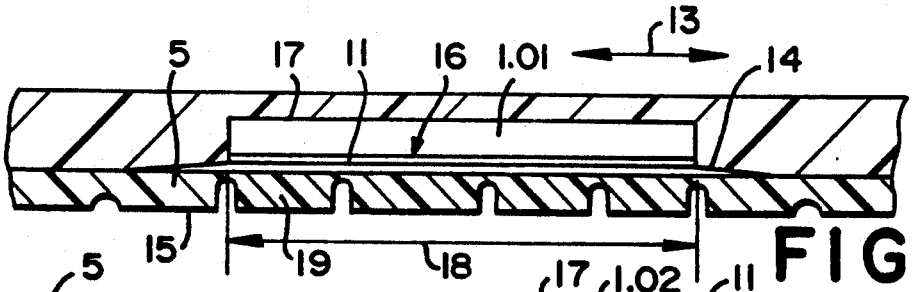
FIG. 5 shows a segment of a longitudinal section of the sole taken along line 5—5 in FIG. 7 with a honeycomb body insert in the area of the forefoot shown in elevation.
Figure 6:
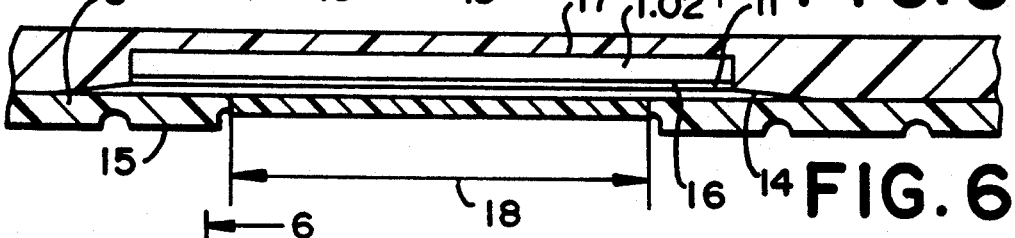
FIG. 6 shows segment of a longitudinal section of the sole taken along line 6—6 in FIG. 7 with a honeycomb body insert in the heel area shown in elevation.

In the embodiments according to FIGS. 5 and 6, cover layer 11 is covered by the sole material and these sole parts are especially solidly bonded to one another, for example, by vulcanization, especially by suitable selection of the materials of sole 5 and cover layer 11.

Figure 7:
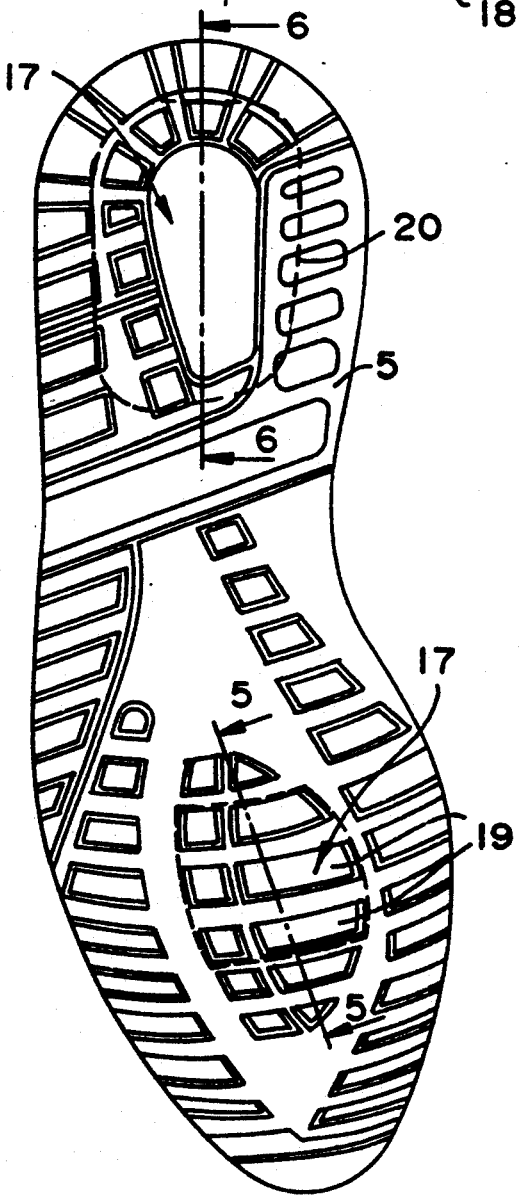
FIG. 7 is a view of the tread surface of the sole.
Figure 8:
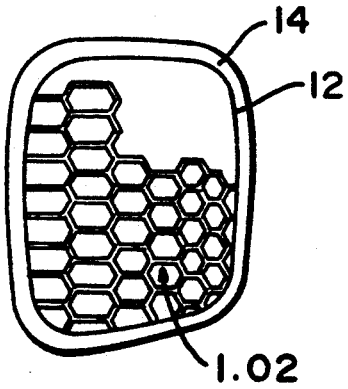
FIGS. 8 and 9 show top plan views of a respective honeycomb body for each of the forefoot and heel areas.
Figure 9:
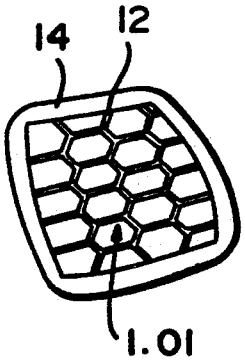

In the embodiment represented in FIG. 5, which shows a segment of a longitudinal section in the forefoot area of the sole of FIG. 7, the surface of area 18 of sole 5 corresponds precisely to the surface of honeycomb body 1.01, the periphery of which is represented by a broken line in the forefoot area of the sole in FIG. 7 and which is shown in greater detail in FIG. 9. In area 18, sole material is formed on cover layer 11 in the form of gripping elements 19. Preferably, transparent material is used for cover layer 11 and sole 5 in area 18, so that the structure of honeycomb body 1 is visible from the outside. In this way, it can immediately be determined for which type of a user a shoe with such a sole 5 is suitable.

Honeycomb body 1 can also be greater than area 18, as represented by FIG. 6. The latter shows a longitudinal section of a segment of the heel area of FIG. 7. Area 18 is smaller in surface area than the surface of honeycomb body 1.02 represented in FIG. 8 and as represented by a broken peripheral line 20 in the heel area of FIG. 7. Area 18 is not provided with gripping elements, in this case, and the outer surface of the sole is recessed inwardly relative to the outer side of tread surface 15. In this way, an increased damping is achieved.

It has turned out to be advantageous if the degree of hardness of honeycomb body 1, sole 5 and area 18 of sole 5 are coordinated to one another, and to select cover layer 11 or the sole material covering it as the softest and honeycomb body 1 as the hardest. The following were determined as advantageous degrees of hardness of the individual materials:

| | |
|---|---|
| Honeycomb body: | Shore A about 63 to 65, |
| Sole: | Shore A about 60, |
| Cover layer or sole material covering it: | Shore A about 56 to 58. |

The shoe according to the invention can especially be used as a sport shoe, preferably, for all types of sports, in which it is important to achieve a stabilizing of the forefoot, if the foot of the user usually tends to tilt inward or outward in running. This applies especially for jogging, cross-country running, marathon running or the like. Moreover, honeycomb body 1 guarantees, in the forefoot area, a high damping effect and sufficient flexibility, since the individual honeycomb cell rows, sloping backward, run preferably in a curved manner from inner side 6 to outer side 7 of sole or midsole 5.

Because of the favorable stabilization of the foot in running and the high damping effect, as well as the high flexibility, the shoe designed according to the invention is also suitable as a rehabilitation shoe, since these properties are especially sought in rehabilitation shoes.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

I claim:

1. A shoe comprising at least one sole layer with at least one insert part in the form of a honeycomb body of elastic compressible material, and having honeycomb cells with central axes running at least approximately perpendicular to a plane parallel to said sole layer; wherein the honeycomb body is provided in an area under a flexible zone of a forefoot area and the surface area of the honeycomb cells increases from one side edge to an opposite side edge of the sole, as seen in a top view.

2. Shoe according to claim 1, wherein the increase in the surface area of the cells occurs continuously.

3. Shoe according to claim 1, wherein the honeycomb body has a cover layer on a side facing a tread surface of the sole; wherein an edge of the honeycomb body has a peripheral edge flange which projects in directions parallel to said plane; and wherein the edge flange is solidly bonded to the sole.

4. Shoe according to claim 3, wherein the honeycomb body is formed of a material, whose degree of hardness is greater than that of the sole layer and cover layer; and wherein the cover layer has a degree of hardness which is less than that of sole layer.

5. Shoe according to claim 4, wherein the material of honeycomb body has a degree of hardness of about Shore A 63 to 65, the material of sole layer has a degree of hardness of about Short A 60 and the material of the cover layer has a degree of hardness of about Shore A 56 to 58.

6. Shoe according to claim 4, wherein honeycomb cells are arranged in rows which slope backward in a curved manner from an inner side to an outer side of the sole.

7. Shoe according to claim 4, wherein the sole layer is a midsole and said flange is bonded to an outsole layer.

8. Sole according to claim 4, wherein the layer is transparent in an area of at least part of the cover layer.

9. Shoe according to claim 6, wherein the surface area of the honeycomb body is greater than that of the transparent area of the sole layer.

10. Shoe according to claim 9, wherein the sole has gripping elements molded on an area covering the honeycomb body.

11. Sole according to claim 4, wherein the sole layer extends over the entire cover layer and is solidly bonded to the cover layer.

12. Shoe according to claim 5, wherein the honeycomb body and the sole layer fare formed of similar materials which are able to be bonded to one another by a molding process.

13. Shoe according to claim 1, wherein the honeycomb body and the sole layer are formed of similar materials which are able to be bonded to one another by a molding process.

14. Shoe according to claim 1, wherein the sole has gripping elements molded on an area covering the honeycomb body.

15. Shoe according to claim 1, wherein a wall thickness of walls defining the honeycomb cells decreases in correspondence with the increase of the surface area of honeycomb cells.

16. Shoe according to claim 1, wherein the honeycomb cells are least approximately gastight.

17. Shoe according to claim 1, wherein honeycomb cells are completely gastight.

18. Shoe according to claim 16, wherein honeycomb cells are arranged in rows which slope backward in a curved manner from an inner side to an outer side of the sole.

19. Shoe according to claim 1, wherein honeycomb cells are arranged in rows which slope backward in a curved manner from an inner side to an outer side of the sole.

* * * * *